United States Patent [19]

Crochet

[11] 4,298,876

[45] Nov. 3, 1981

[54] POLARIZER FOR MICROWAVE ANTENNA

[75] Inventor: Pierre Crochet, Paris, France

[73] Assignee: Thomson-CSF, Paris, France

[21] Appl. No.: 123,950

[22] Filed: Feb. 25, 1980

[30] Foreign Application Priority Data

Mar. 2, 1979 [FR] France ..... 79 05499

[51] Int. Cl.[3] ..... H01Q 19/195

[52] U.S. Cl. ..... 343/756; 343/781 P; 343/872

[58] Field of Search ..... 343/753, 754, 756, 781 D, 343/781 CA, 909, 872

[56] References Cited

U.S. PATENT DOCUMENTS

| | | | |
|---|---|---|---|
| 3,092,834 | 6/1963 | McCann et al. | 343/915 |
| 3,137,000 | 6/1964 | Fuller | 343/756 |
| 3,340,535 | 9/1967 | Damonte et al. | 343/781 CA |
| 3,448,455 | 6/1969 | Alfadari et al. | 343/756 |
| 3,633,206 | 1/1972 | McMillan | 343/754 |
| 3,771,160 | 11/1973 | Lauerick | 343/756 |
| 3,820,116 | 6/1974 | Carlsson | 343/781 CA |
| 3,990,080 | 11/1976 | Lundgren, Jr. et al. | 343/782 |
| 4,070,678 | 1/1978 | Smedes | 343/756 |
| 4,125,841 | 11/1978 | Munk | 343/909 |

FOREIGN PATENT DOCUMENTS

| | | |
|---|---|---|
| 2349968 | 4/1948 | France . |
| 600433 | 11/1977 | United Kingdom . |

*Primary Examiner*—Eli Lieberman

*Attorney, Agent, or Firm*—Cushman, Darby & Cushman

[57] ABSTRACT

A reflection-type polarizer for modifying the polarization of an incident electromagnetic wave. The polarizer comprises a reflector positioned at a predetermined distance from a polarization filter constituted by a metal plate having a bi-dimensional periodic network of resonant slots at the operating frequency. The polarizer has application to microwave antenna systems and particularly to Cassegrain antennas.

10 Claims, 5 Drawing Figures

FIG_1
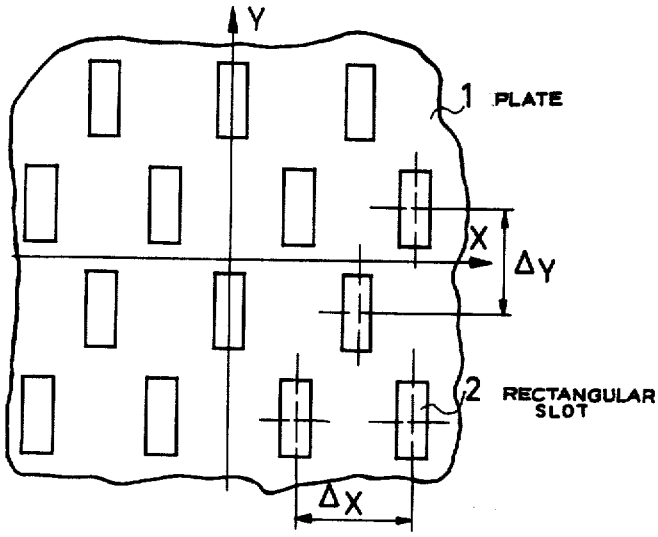
FIG_2
FIG_2a
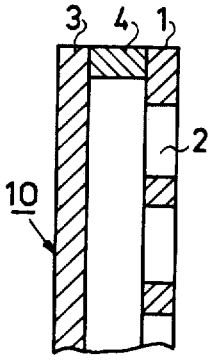
FIG_2b
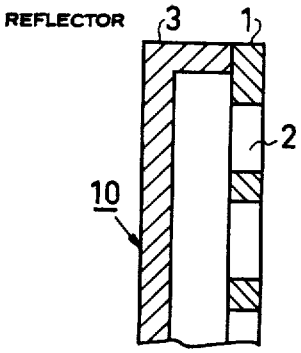
FIG_2c
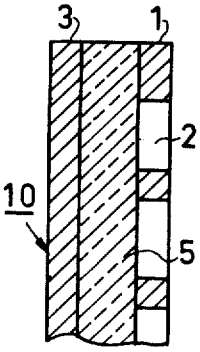
FIG_3
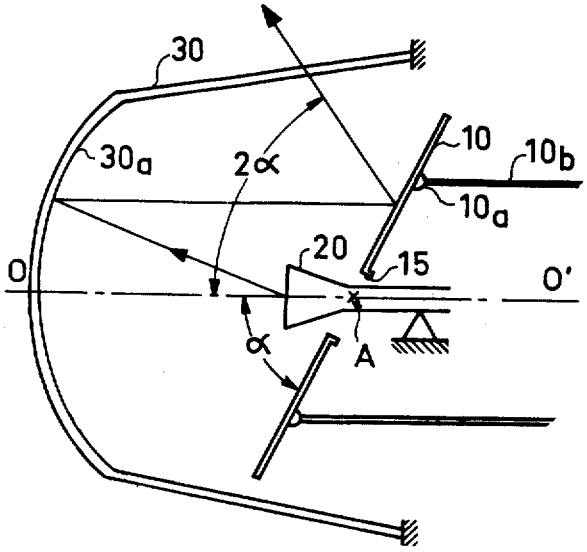

POLARIZER FOR MICROWAVE ANTENNA

BACKGROUND OF THE INVENTION

The invention relates to an apparatus making it possible to modify the polarization of an electromagnetic wave and its application to microwave antenna systems and in particular to Cassegrain antennas.

Apparatus making it possible to modify the polarization of an electromagnetic wave are known under the generic term of "polarizers". There are two types of polarizers, the first operating in transmission and the second operating by reflection. The invention relates essentially to the second type of polarizer.

A polarizer by reflection operating at a wavelength $\lambda$ essentially comprises two facing elements, whereof the radio spacing is approximately $\lambda/4$, the first element or reflector being constituted by a conducting surface and a second element constituted by a polarization filter.

Reflection polarizers are in particular described in the article by P. W. Hannan "Microwave antennas derived from the Cassegrain telescope" published in I.R.E.-Transactions of Antennas and Propagation, March 1961 in which the polarization filter is constituted by a network of small diameter metal wires arranged in parallel in the thickness or on the surface of a dielectric material plate. This type of polarizer has certain disadvantages, particularly the difficulty of mechanically constructing the network of wires with a sufficient accuracy, a higher cost of manufacture and a certain relative fragility. To obviate these disadvantages, it has been proposed, particularly in French Pat. No. 1,499,206 to construct a polarization filter constituted by a network of metal plates physically integral with the reflector.

This polarizer is able to operate in a wider frequency band than the wire polarizer, however, the manufacturing cost remains high and the thickness of the polarizer leads to certain limitations regarding its use.

Polarizers have applications in microwave antenna systems and in particular in antenna systems of the Cassegrain type, which are described in detail in the abovementioned article by P. W. Hannan.

In Cassegrain antennas, particularly those in which the polarizer is also used for orienting the radiated wave beam, the polarizer must rotate the polarization plane of the microwave by 90°, must have a low inertia and limited thickness and must be constructed as to be relatively inexpensive.

BRIEF SUMMARY OF THE INVENTION

The invention is directed at obtaining the above advantageous features. It is generally known and as described in the article by C. C. Chen "Transmission of microwaves through perforated flat plates of finite thickness", published in I.E.E.E. Trans. Microwave Theory Tech., January 1973, a thin plate having a bidimensional periodic network of resonant slots has a unitary transmission coefficient at a given frequency the resonant frequency of the slots, for an incident electromagnetic wave whose electric field vector $\vec{E}$ is oriented perpendicular to the longitudinal axis of the slots and, conversely, a unitary reflection coefficient for an incident electromagnetic wave whose electric field vector $\vec{E}$ is oriented parallel to the longitudinal axis of these slots.

In order to achieve the sought objective, a polarizer according to the invention comprises a polarization filter of the resonant slot type and means making it possible to join the polarization filter to the reflector.

The advantages resulting from such an anisotropic reflector are immediately apparent, namely the polarization filter can be constructed with a precision compatible with an operation in high microwave bands, specifically $K_u$ and higher. The filter constituted by a thin metallic plate is intrinsically of low inertia. The polarizer can be made from a plate of dielectric material having low losses. Conductive metal sheets are arranged on the surfaces of this plate and the gaps are obtained on one of these surfaces by photogravure, widely used in the field of printed circuits.

BRIEF DESCRIPTION OF THE DRAWINGS

The invention is described in greater detail hereinafter with reference to an embodiment of a polarizer for a microwave antenna and with reference to the attached drawings, wherein show:

FIG. 1 a polarization filter of an electromagnetic wave of the resonant slot type.

FIG. 2*a* a part sectional view of a first embodiment of a polarizer according to the invention.

FIG. 2*b* a part sectional view of a variant of the polarizer of FIG. 2*a*.

FIG. 2*c* a part sectional view of an embodiment of a polarizer according to the invention.

FIG. 3 a microwave antenna of the Cassegrain type including a polarizer according to the invention.

DETAILED DESCRIPTION OF THE PREFERRED EMBODIMENTS

Reference will now be made to FIG. 1 which shows a polarization filter constituted by a thin metal plate in which there is made a system of resonant slots at the frequency of the incident electromagnetic wave.

Plate 1 is made from a metal material having a high electrical conductivity. It has a bidimensional periodic network of rectangular slots 2, whose resonant frequency is defined by their dimensions, the width and the length. The transmission coefficient is defined by the dimensional periodicity of the slots and their relative spacing $\Delta X$ and $\Delta Y$ according to the main axes X and Y. The design methods for resonant slot systems are known and are in particular described in the abovementioned article by C. C. CHEN.

FIG. 2*a* is a part sectional view of an embodiment of a polarizer 10 according to the invention. This polarizer comprises a polarization filter constituted by a rigid conductive metal plate 1 in the thickness of which there is a system of slots 2 in accordance with that described in FIG. 1. These slots can be obtained by a press cutting process or by milling, when there are only relatively small numbers. The reflector 3 is constituted by a continuous conductive metal plate. Members 1 and 3 are mechanically joined together by a peripheral frame 4, advantageously made from the same material as that used for reflector 3 and plate 1.

FIG. 2*b* shows a constructional variant of FIG. 2*a* according to which reflector 3 is provided with a border to the surface of which is connected the metal plate 1 with resonant slots 2.

FIG. 2*c* shows another constructional variant of a polarizer according to the invention. In this variant, the polarizer is constituted by a dielectric plate 5, whose two faces are covered by conductive metal sheets, namely a first continuous sheet constituting the reflector 3 and a second sheet in which the system of slots 2 can be obtained by the process used in printed circuits.

A slot polarizer according to the invention functions as follows. As stated hereinbefore, the presence of resonant slots permits the transmission without losses at a given frequency of an electromagnetic wave, whose vector $\vec{E}$ is perpendicular to axis $\gamma$ of the network and the total reflection of an electromagnetic wave whose vector $\vec{E}$ is orthogonal to said axis $\gamma$ of the network.

An incident wave, whose polarization vector is at 45° from the axis Y can be considered as the resultant of two orthogonal waves of equal amplitude, a first component oriented in accordance with axis Y and a second component oriented in accordance with axis X. At the resonant frequency of the slots, the wave polarized perpendicular to the slots traverses the latter without attenuation and is then reflected by the reflector after which it again traverses the system of gaps. The overall phase displacement undergone by this wave is given by the relationship:

$$\phi_1 = \frac{4\pi e}{\lambda} + \pi$$

in which e is the spacing between the polarization filter and the reflector and $\lambda$ is the resonant wave length of the slots.

Conversely, the wave polarized parallel to the gaps is reflected totally at the surface of the polarization filter where it undergoes a phase displacement $\phi_2 = \pi$. The differential phase $(\phi_1 - \phi_2) = \phi_D$ determines the polarization of the wave reflected by the polarizer. It is dependent on the relative spacing e of the two elements, taking account of the dielectric constant of the medium.

For a relative phase displacement $\phi_D = \pi$ transmits back a resultant wave, whose polarization plane has turned by an angle of $\pi/2$ compared with the incident wave.

It is thus apparent that the operation of the polarizer is linked with the resonant frequency of the gaps and with the magnitude of the relative phase displacement between the orthogonal components of the incident wave and consequently the value of the spacing e and the dielectric constant of the medium.

FIG. 3 shows in diagrammatic manner an application of a polarizer according to the invention to a known microwave antenna derived from a Cassegrain-type optical system.

In FIG. 3, the antenna comprises a primary source 20, for example a horn, arranged on the axis of symmetry O, O' within a transparent radome 30, whose portion 30*a* constitutes a parabolic surface on which is arranged a network of parallel metal wires (not shown), which constitutes the focusing element of the antenna. The circular resonant slot polarizer 10 has a central opening 15 for receiving the primary source 20. The polarizer can move in two orthogonal directions about a fixed point A by means of a mechanism having ball joints 10*a* and rods 10*b*.

The primary source transmits a rectilinearly polarized wave, whose polarization direction is parallel to the network of wires of the focusing element 30*a* and the axes X, Y of the polarizer are oriented at 45° with respect to the network of wires of the focusing element. This antenna functions as follows. The wave transmitted by the primary source is reflected and focused by the reflecting elements 30*a* and is then transmitted to the polarizer 10 where, by reflection. it undergoes a polarization rotation of $\pi/2$ and then passes through the network of wires. As is known a rotation angle $\alpha$ of the polarizer deflects the output wave of the antenna by an angle $2\alpha$.

A resonant slot polarizer of the type described hereinbefore can operate in a frequency band, whose width is a function of the admissible differential phase error, which can be approximately $\pm 5°$, making it possible to obtain a band width of a few percent.

The construction materials for the polarizer are on the one hand copper, aluminum and its alloys and in general terms metals having a high conductivity and a low specific gravity and on the other hand various dielectric materials, for example glass/polyimide laminates ($\epsilon_r = 4$ to 6), glass/epoxy resin laminates ($\epsilon_r \simeq 4$ to 5), glass/teflon ($\epsilon_r \simeq 2$) and optionally alumina ($\epsilon_r \simeq 9$).

The invention as described hereinbefore is not limited in its applications to the construction of polarizers permitting the rotation of the polarization of an incident wave by $\pi/2$ and the installation thereof in Cassegrain-type antennas and can instead be used in other ways, such as the separation of a number of waves, the transformation of a circular polarized wave into a linear polarized wave or vice versa, etc.

What is claimed is:

1. A polarizer for a microwave antenna operating at a wavelength $\lambda$, comprising:

a polarization filter;

a reflector; and means for rigidly joining said polarization filter and said reflector so that they are spaced at a distance $\lambda/4$ from one another, the polarization filter including a conductive plate, and a periodic network of resonant slots at the operating frequency of the antenna provided in said conductive plate.

2. A polarizer according to claim 1 wherein said means for rigidly joining comprises a boarder formed on said reflector to which is rigidly attached a portion of said polarizing filter.

3. A polarizer according to claim 1 wherein said reflector and polarization filter are fabricated from a metallic material.

4. A polarizer according to claim 1 wherein said polarizing filter and reflector comprise a dielectric panel metallized on both faces thereof.

5. A polarizer according to claim 1 further comprising a central opening therein.

6. A microwave antenna, comprising:

a radome having a network of parallel wires on a face thereof;

a primary source located on an axis of the antenna and within said radome; and a movable polarizer, the polarizer comprising a polarization filter, a reflector, and means for rigidly joining said polarization filter and said reflector so that they are spaced at a distance $\lambda/4$ from one another, the polarization filter including a conductive plate, and a periodic network of resonant slots at the operating frequency of the antenna provided in said conductive plate.

7. A microwave antenna according to claim 6 wherein said means for rigidly joining comprises a boarder formed on said reflector to which is rigidly attached a portion of said polarizing filter.

8. A microwave antenna according to claim 6 wherein said reflector and polarization filter are fabricated from a metallic material.

9. A microwave antenna according to claim 6 wherein said polarizing filter and reflector comprise a dielectric panel metallized on both faces thereof.

10. A microwave antenna according to claim 6 further comprising a central opening therein.

* * * * *